United States Patent [19]

Kaufmann

[11] 3,976,005

[45] Aug. 24, 1976

[54] PRINTING PLATE FOR USE WITH LOCKUP MEANS

[75] Inventor: Harold Kaufmann, Rochester, Minn.

[73] Assignee: Houdaille Industries, Inc., Buffalo, N.Y.

[22] Filed: Aug. 25, 1975

[21] Appl. No.: 607,374

Related U.S. Application Data

[63] Continuation of Ser. No. 433,398, Jan. 14, 1974, abandoned.

[52] U.S. Cl. ..... 101/395; 101/415.1

[51] Int. Cl.[2] ..... B41N 1/04; B41F 27/00

[58] Field of Search ..... 101/415.1, 379, 395; 72/365; 161/109

[56] References Cited

UNITED STATES PATENTS

| | | | |
|---|---|---|---|
| 739,498 | 9/1903 | Klaber | 101/415.1 |
| 1,996,582 | 4/1935 | Marchev | 101/415.1 X |
| 2,194,560 | 3/1940 | Marchev et al. | 101/415.1 |
| 2,204,935 | 6/1940 | Kampczyk | 101/415.1 |
| 2,965,025 | 12/1960 | Mueller | 101/415.1 |
| 3,135,311 | 6/1964 | Green | 72/325 X |
| 3,533,355 | 10/1970 | Wall | 101/415.1 |

*Primary Examiner*—Edgar S. Burr
*Assistant Examiner*—Paul J. Hirsch
*Attorney, Agent, or Firm*—Hill, Gross, Simpson, Van Santen, Steadman, Chiara & Simpson

[57] ABSTRACT

A printing plate and saddle are provided for a press roll wherein the printing plate, at each end, has a series of sheer-forms which define slits and indented formations, the slit-edge of the formation being engageable with radial face means on the saddle which are tensioned apart, there being keeper blades or elements overhanging the leading and trailing edges of the plate. Preferably, a blade release member is associated with at least one of the keeper blades to facilitate installation and removal of the plate.

4 Claims, 2 Drawing Figures

PRINTING PLATE FOR USE WITH LOCKUP MEANS

Figure 2:
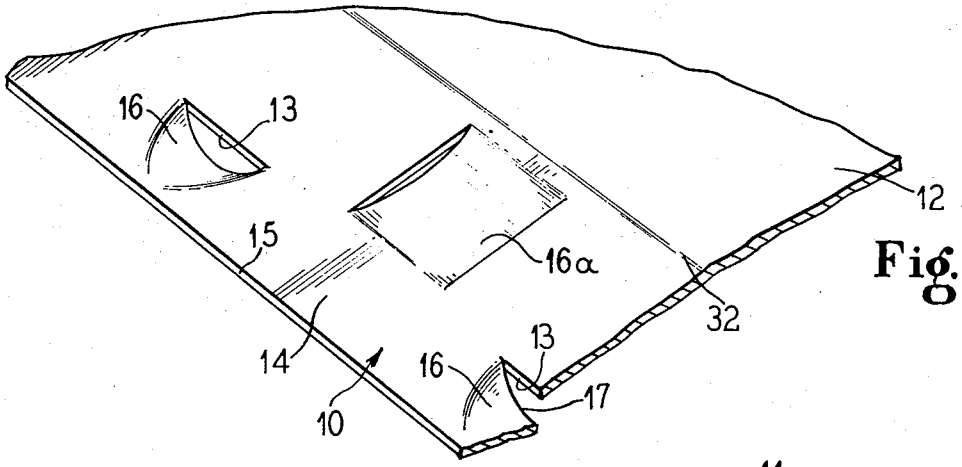

This is a continuation of application Ser. No. 433,398, filed Jan. 14, 1974, abandoned with the filing of this application.

BACKGROUND OF THE INVENTION

1. Field of the Invention

This invention relates to printing plates used with saddles.

2. Prior Art

Printing rolls which use Linotype plates are relatively expensive, and to convert such a press to the use of inexpensive thin direct plates has heretofore involved the use of saddles which are secured to the printing rolls in lieu of the Linotype plate, the saddles themselves having a lockup mechanism for securing the relatively thin and inexpensive flexible plates thereto.

It has been known to provide holes in the ends of the printing plate to cooperate with lockup mechanism, and to further crimp such plates to assist their being held. Certain of these holes have also been used for registration purposes. Such an arrangement creates lines of weakness that tend to cause the plate to split at such holes during long press runs. With the prior art, it has been relatively difficult to automate plate manufacture in that a number of operations are required.

Further, with prior art structures, there have been loading and unloading difficulties since a press can't be reversed and only one of the plate edges is accessible. Where holes have been used, they tend to elongate during the longer press runs and thus registration control is lost.

Further, in the past, there have been undercut areas or pockets beneath the printing area to provide areas of relative weakness. If and when the paper web breaks, it tends to wrap around a roll, such condition being called in the trade a "wrap up". There might be 20 revolutions of a roll before the press is stopped, and the presence of such a quantity of paper creates a particularly large pressure under the saddle, rendering it susceptible to breakage at the points of relative weakness defined by any such pockets.

In prior manufacture referred to above, a typical first operation was to provide general forming and to include registration holes. The second operation typically included crimping of the marginal edge, and accuracy in crimping has been difficult to maintain because any inaccuracy in the crimping is reflected in loss in accuracy of registration.

SUMMARY OF THE INVENTION

According to this invention, a series of shear-forms or slit-formations are provided along the leading and trailing edges of the printing plate, and such slit-formations are so arranged that the sheared edge of the formation serves as an abutment against which the printing plate is circumferentially tensioned by the saddle about the axis of the printing roll.

Accordingly it is an object of the present invention to provide a novel reliable printing plate.

A still further object of the present invention is to provide a printing plate structure wherein means that is used to hold the plate on the roll is also used to serve as registration means.

Yet another object of the present invention is to avoid the use of stress-raising holes and to use a structure which resists the creation of lines of weakness that tend to split during long press runs.

A still further object of the present invention is to provide structure of the type described which can be automatically manufactured in one operation.

A still further object of the present invention is to provide a structure of the type described which can be unloaded from the leading edge of the plate.

Another object of the present invention is to provide structure of the type described which is particularly simple, whereby less mechanism is exposed and subjected to failure.

Many other advantages, features and additional objects of the present invention will become manifest to those versed in the art upon making reference to the detailed description and the accompanying drawing in which a preferred structural embodiment incorporating the principles of the present invention is shown by way of illustrative example.

ON THE DRAWINGS

Figure 1:
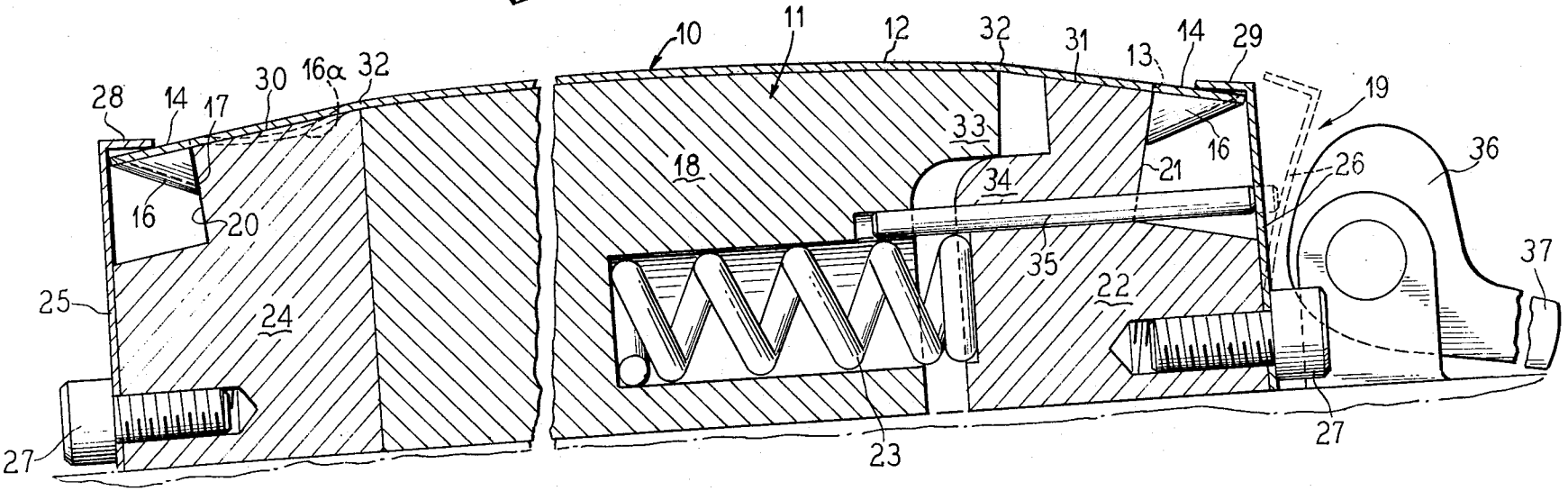

FIG. 1 is an enlarged horizontal cross sectional view, partially broken away of the saddle and printing plate provided in accordance with the present invention; and FIG. 2 is a fragmentary enlarged portion of an end of the printing plate.

AS SHOWN ON THE DRAWINGS

The principles of the present invention are particularly useful when embodied in a printing plate 10, a saddle 11, the printing plate 10 and saddle 11 being complemental to one another and used together. The printing plate 10 can be made of known materials for printing plates of this type including plates which are entirely metal or plates which are plastic but which are provided with metal backing. These are referred to herein as sheets of flexible material having at least one layer of metal, one surface 12 being capable or serving as a printing surface. A series of slits 13 is sheared into each end of the plate 10. In this embodiment, they are spaced approximately 1 inch apart and are about ⅛ inch in width. The number of such slits can be increased but should not exceed a combined length more than 50 percent of the width of the plate. A marginal portion 14 lying between the slits 13 and the adjacent edge 15 is provided with a corresponding number of formed indented formations 16 which are drawn out of the plane of the plate away from the printing surface. Each slit formation 16 has an edge 17 which is used as an abutment surface, the edge 17 in this embodiment being substantially semi-circular. When the slit formation 16 is viewed in a direction perpendicular to the sheet, the embodiment shown is substantially triangular, appearing much like an isosceles triangle. When the slit formation 16 is viewed in the direction of the length of the slit, it has the shape of a right triangle as seen in FIG. 1. The extent to which the slit formation projects away from the plane of the sheet is several times more than the sheet thickness. Thus there is a series of slit formations 16 along each edge, the leading and the trailing edges, which project the same way away from the printing surface but which have abutment edges which face in opposite directions, namely toward each other when the sheet is flat. The slit formation 16 is preferred but other formations could be utilized, such as corrugation, the central requirement being that there is a sheared slot with the portion adjacent thereto being drawn to provide a projection which exposes one of the edges of the original slit. The slit formations 16*a* also serve as the registration structure on the printing plate.

As shown in FIG. 1 the printing roll or saddle 11 includes a base 18 which is provided with appropriate lockup means generally referred to as 19. The lockup means 19 includes a first radial face means 20 at one end of the base 18 and a second radial face means 21 at the other end of the base 18 and carried on a separate replaceable tension lock 22. The radial face means 20, 21 are directed or faced in opposite circumferential directions. An urging means 23 urges the radial face means 20, 21 apart, the means 23 here comprising at least one compression spring acting between the base 18 and the tension block 22, the ends of the spring 23 being disposed in a recess in one or the other or both of these parts. Where the plate is generally cylindrical so as to extend 180°, the radial face means 20, 21 are urged closer together, but in both instances, such urging is in a direction to tension the plate 10. The first radial face means 20 is carried on a separate replaceable element 24 which is provided with suitable hardness and finish, like the tension block 22, for acting against the slit formations 16.

A pair of preferable but optional resilient keeper blades 25, 26 are respectively secured to the element 24 and the tension block 22 by a number of screws 27. The keeper blades 25, 26 project generally radially and have inturned generally tangential outer ends 28, 29 which overhang the marginal portion 14 at each end of the printing plate 10. Thus, one of the blades 25 is on the base 18 while the other blade 26 is on the tension block. The saddle 11 is recessed in two ways at each of the radial face means 20, 21. In each instance, a groove is provided that defines such radial face means 20, 21, however, in addition, at the outer end of each of the radial face means 20, 21, the upper surface of the element 24 and the upper surface of the tension block 22 is angularly recessed or cut away as at 30, 31 and a corresponding bend 32 is provided at each of the printing plate. (The leading edge and the trailing edge of the printing plate 10 are identical and one edge is the leading and one edge is the trailing edge solely by virtue of the way in which the same happens to be installed in a particular press.)

The printing surface 12 between the slight bends 32, 32 is the active printing surface of the plate 10. The outer surface of the base 18 immediately therebelow is arcuate, it being curved about the axis of the printing roll as shown. If that portion of the base and plate were extended, such as by construction lines, they would clear the upper edge of the end portions 28, 29 of the keeper blades 25, 26. Thus in use, there is in fact a slight operational clearance. Thus the recesses at 30, 31 provide necessary functional clearance for the outer ends 28, 29 as explained. The relatively small size recesses in which the springs 23 are disposed are spaced sufficiently far apart so that the printing area is well supported from below. In like manner, the base 18 has a shoulder 33 which is actually negligible in size which overhangs a portion 34 of the tension block 22 in slidable engagement. The coaction between the portions 33, 34 serves to hold the tension block 22 against outward movements due to centifugal force and also serves to support the shoulder 33 from below to resist any radial compressive forces caused by any "wrap up".

Assuming that the left end of the plate 10 is the leading edge, when that presents itself to the operator, a tool can be used against the keeper blade 25 to deflect this resilient blade in a forward direction, thus enabling access to the leading edge of the plate 10 which can be pried out. The press can then be advanced slightly so as to gain access to the trailing edge which can be released in a similar manner. The release of the first end enables the spring 23 to expand to shift the tension block slightly to the right from the position drawn.

Preferably, there is provided a blade release member 35 or blade release means, here in the form of at least one pin carried by the tension block 22. One end of the pin engages the keeper blade 26 and the other end of the pin can engage the base 18 in response to movement of the tension block 22 to the left against the force of the spring 23. Means for effecting such movement is diagrammatically illustrated in the form of a cam 36 which can be manually actuated by a handle 37 and which acts against the tension block 22 without interference with the keeper blade 26. Thus, the radial face means 21 can be shifted to the left, and this movement can continue after the blade release member 35 has been engaged at both ends, and as that movement continues, a point on the blade 26 remains substantially stationary, this point being between the point of attachment and the outer end so that as the tension block 22 moves further to the left, the keeper blade 26 is moved to the left at its lower end but is retained stationary just below its center whereby the movement of the outer end is amplified, the engagement of the pin 35 with the keeper blade 26 being in the form of a second class lever. One could also consider the blade release member as being a fulcrum about which the outer end pivots as the lower end is moved inwardly a lesser amount.

The keeper blades 25, 26 typically are made of spring steel and can be formed to be preloaded when installed as shown. They provide a safety feature which, in some instances, may not be necessary. The relatively large gap between the base 18 and the tension block 22 not only enables the keeper blade 26 to shift the position shown in solid lines to the position shown in phantom, but also enables the structure to compensate for minor variations in plate length and for stretching or growth of the plate during use. The keeper blades 25, 26 can be supported in any desired manner so long as the radially outer ends thereof are movable from the position shown to a position of clearance.

The plate 10 has an initial thickness on the order of 0.030 inch, and the printing surface 12 is etched away, be it metal or plastic, so as to provide raised printing, such etching continuing until the marginal portion 14 has a thickness on the order of 0.010 inch. It is at this time that the shearing of the slits 13 and the drawing of the formations 16 is carried out. This cutting and forming can be performed in a single operation including the step of providing the slight bend of the plate along the lines 32, thus lowering cost while increasing reliability and accuracy. Further, the registration formations 16*a* are also made at the same time in the same operation, remote from the area containing printing. In the embodiment shown, the registration formation comprises a pair of parallel slits with the portion therebetween deformed so as to define a projection that projects into the element 24, which has a slot of corresponding width, so that the edges of the formation 16*a* abut against the walls of such slot to locate or register the printing plate precisely in a lateral direction. With this construction, no slug is removed, thereby eliminating any possibility that mischief or damage could be caused by such slug. If desired, the plate may thereafter be curved in a known way without damage to the formations 16, 16*a*.

Although various minor modifications might be suggested by those versed in the art, it should be understood that I wish to embody within the scope of the patent warranted hereon, all such embodiments as reasonably and properly come within the scope of my contribution to the art.

I claim as my invention:

1. A printing plate adapted to be tensionably mounted on and rotated by a press roll by means of a lock-up means, said plate comprising:

a. A sheet of flexible material including at least a layer of metal, said sheet having a surface capable of serving as a printing surface, there being a plurality of aligned straight slits lying in a marginal planar portion along one edge of said sheet for being disposed parallel to the rotational axis of the press roll, parts of said marginal portion lying between each said slit and said edge of the sheet being indented drawn formations of single thickness integral throughout their peripheries with said marginal portion other than at an arcuate edge of the formation facing the edge of said sheet which is opposite to said one edge of the sheet, said formations projecting out of the plane of the marginal portion in a direction away from said printing surface, whereby the entirety of the arcuate edges of all of said formations which define said slits all face away from said one edge for abutting edgewise with a plane surface on the lock-up means in the direction of its circumference.

2. A printing plate according to claim 1 in which the extent of projection of said drawn formations is at least three times the thickness the adjacent material.

3. A printing plate according to claim 1 in which the shape of said drawn formation is that of a right triangle as viewed in the direction of the length of said slit.

4. A printing plate according to claim 1 having a number of said drawn formations at the opposite end of said sheet, projecting in the same direction as said first-named formations, but each having an edge facing in an opposite circumferential direction; and a base, first radial face means on said base engaging with said first-named formations at one end of said plate, a tension block on said base and having second radial face means directed away from said first radial face means and engaging with the second-named formations at the opposite end of said plate, and means acting on said tension block and normally urging it in a direction by which said printing plate is tensioned.

* * * * *